United States Patent [19]

Helm

[11] Patent Number: 4,642,085

[45] Date of Patent: Feb. 10, 1987

[54] APPARATUS FOR MAKING WINDOW PATCHES

[75] Inventor: Herbert W. Helm, Hollidaysburg, Pa.

[73] Assignee: F. L. Smithe Machine Company, Inc., Duncansville, Pa.

[21] Appl. No.: 721,201

[22] Filed: Apr. 9, 1985

Related U.S. Application Data

[63] Continuation-in-part of Ser. No. 383,117, May 28, 1982, abandoned.

[51] Int. Cl.[4] ..... B31B 1/82

[52] U.S. Cl. ..... 493/222; 493/223; 493/919; 493/905; 493/370; 493/123; 156/519; 156/514; 198/471.1; 198/689.1; 271/196

[58] Field of Search ..... 493/222, 223, 919, 905, 493/60, 366, 370, 213, 369, 123, 265, 224; 156/514, 519, 521; 53/383; 271/96, 197, 276; 198/689

[56] References Cited

U.S. PATENT DOCUMENTS

| | | | |
|---|---|---|---|
| 2,660,844 | 12/1955 | Schroeder | 53/383 X |
| 2,956,484 | 10/1960 | Subklen | 493/222 |
| 2,958,437 | 11/1960 | Mengis | 156/519 |
| 3,410,162 | 11/1968 | Ruggeri | 83/100 |
| 3,751,324 | 8/1973 | Enskat | 156/521 |
| 3,957,570 | 5/1976 | Helm | 493/222 |
| 4,291,974 | 9/1981 | Silverburg | 198/689 X |

FOREIGN PATENT DOCUMENTS

| | | | |
|---|---|---|---|
| 1030920 | 5/1966 | United Kingdom | 493/222 |

*Primary Examiner*—Francis S. Husar
*Assistant Examiner*—David B. Jones
*Attorney, Agent, or Firm*—Stanley J. Price, Jr.

[57] ABSTRACT

Apparatus for severing window patches from a web of patch material includes a mechanism for applying adhesive to selective portions of the web, a pair of cooperating rolls to feed the web to the adhesive applying mechanism, a vacuum roll engaging successive window patches with adhesive, a severing mechanism cutting successive window patches of a pre-selected length from the web in spaced relation to a portion of the web engaged to the surface of the vacuum roll, a vacuum conveyor positioned between the adhesive applying mechanism and the severing mechanism to advance the web along a path from the adhesive applying mechanism toward the severing mechanism, a discharging end portion of the vacuum conveyor being spaced from the severing mechanism. The vacuum conveyor is constructed and arranged to transport the web from the adhesive applying mechanism, a pre-selected distance through the vacuum roll before the web is transferred to the vacuum roll and from the latter to the severing mechanism.

18 Claims, 5 Drawing Figures

APPARATUS FOR MAKING WINDOW PATCHES

RELATION TO OTHER APPLICATIONS

This is a continuation-in-part of U.S. patent application Ser. No. 383,117 of Herbert W. Helm, filed May 28, 1982, now abandoned.

BACKGROUND OF THE INVENTION

1. Field of the Invention

This invention relates to apparatus for making window patches from a web of patch material and more particularly to vacuum conveying apparatus for advancing a web of patch material with adhesive on selected portions of one surface thereof along a linear path a preselected distance to severing apparatus for severing successive window patches for application around the periphery of the windows formed in envelope blanks or an envelope web and to a web positioning device for positioning the web in the severing apparatus to prevent contact between the severing apparatus and the adhesive.

2. Description of the Prior Art

The severing of patch material from a web and positioning patch material in overlying relation with the window portion of an envelope blank or a web of envelope material is disclosed in U.S. Pat. Nos. 3,869,965; 3,745,893; 3,618,483; 3,431,830; and 3,410,162. The adhesive material can be applied to the periphery of the window portion of the envelope blank and then the severed window patches applied to the envelope blank with the adhesive thereon, such as disclosed in the U.S. Pat. No. 3,869,965. In the alternative, as disclosed in the U.S. Pat. No. 3,618,483, a patch severing apparatus is arranged to sever window patches of selected length. The window patch web is transferred to the periphery of a vacuum roll. A knife blade positioned on the periphery of a vacuum roll cooperates with an adjacent backing knife blade to sever a window patch from the web after the web has been transferred to the vacuum roll. Adhesive is then applied to the severed patch after it is released from the vacuum roll. In the U.S. Pat. Nos. 3,410,162 and 3,745,893 adhesive is applied to the web of window patch material before the web is severed. The web with adhesive applied thereto is transferred to a vacuum roll. The web is then cut on the vacuum roll by the knife of a rotating cutter roll to form individual patches that adhere to the periphery of the vacuum roll. The pregummed patches are then applied to the envelope blanks or envelope web. In U.S. Pat. No. 3,410,162 the vacuum roll is covered with a porous screen or fabric to distribute the partial vacuum from the ports of the roll over a large portion of the surface of the vacuum roll.

After the adhesive material is applied to the web of window patch material or to the severed window patch, it is preferred that the adhesive be permitted to preset prior to application to the envelope blank or web of envelope material. Presetting of the adhesive assures positive bonding between the window patch and the envelope blank or web. If the vacuum roll is positioned closely adjacent to the adhesive applicator, there may be insufficient time for the adhesive to preset before the web is severed and the patch applied to the envelope blanks, particularly for a high-speed patching operation.

Therefore, there is need in high-speed window patch making operations for patch severing and applying apparatus that assures positive bonding of the window patch to the envelope blank to eliminate incomplete bonding of the patch to the envelope blank by permitting a desired presetting of the adhesive before the patch is applied.

Further, if one employs patch severing apparatus independent of a vacuum roll to allow only severed window patches with adhesive thereon to be provided to the vacuum roll, there is a possibility that some of the adhesive on the web could come in contact with the patch severing apparatus and interfere with its operation. Accordingly, there is a need in such a high-speed patching operation to insure that there is no contact between the adhesive and the severing apparatus.

SUMMARY OF THE INVENTION

In accordance with the present invention, there is provided apparatus for severing window patches from a web of patch material that includes means for applying adhesive to selected portions of the web of patch material. A pair of cooperating rolls feed the web to the means for applying adhesive. A vacuum roll engages successive window patches with adhesive on one surface thereof. Severing means cuts successive window patches of a preselected length from the web while a portion of the end of the web is engaged to the surface of the vacuum roll. A vacuum conveyor is positioned between the means for applying adhesive and the severing means. The vacuum conveyor is operable to advance the web with adhesive applied to selected portions of the web along a linear path from the means for applying adhesive toward the severing means. The vacuum conveyor has a receiving end portion positioned closely adjacent the means for applying adhesive and a discharging end portion spaced from the severing means. The vacuum conveyor is arranged to push the web from the discharging end portion a preselected distance to the vacuum roll before the web is transferred to the vacuum roll and the window patches are cut.

Further in accordance with the present invention, there is provided web conveying apparatus that includes a housing having a vacuum passageway connected to a source of reduced pressure. A stationary plate is positioned on the housing and overlies the vacuum passageway. The stationary plate has a plurality of suction ports open to the vacuum passageway. A movable plate is positioned in overlying relation with the stationary plate. The movable plate is supported for longitudnial movement relative to the stationary plate. The movable plate has a plurality of suction ports positioned in selected registry with the stationary plate suction ports. A driven conveyor having a web receiving end portion and a web discharging end portion is positioned adjacent opposite ends of the housing respectively. The driven conveyor includes a conveying surface extending between the receiving end portion the discharging end portion for the web. The conveying surface is positioned above the housing and extends in overlying relation with the stationary and movable plates. The conveying surface is porous to communicate with the suction ports in the stationary and movable plates to apply a reduced pressure force to the conveying surface. The movable plate is adjustable relative to the stationary plate to control the size of the registered ports communicating with the vacuum passageway to adjust the magnitude of the reduced pressure force applied to the conveying surface.

Preferably, the web receiving end portion of the conveyor is positioned closely adjacent to apparatus for applying adhesive to selected portions of one surface of web patch material. A pull roll and an idler roll feed the web to the adhesive applicator. The conveyor advances or pulls the web from the adhesive applicator toward the vacuum roll. The web is maintained on the conveying surface formed by an upper run of the conveyor by the reduced pressure force applied through the porous conveying surface and the registered suction ports of the stationary and movable plates. By adjusting the position of the movable plate on the stationary plate, the size of the passageways formed by the registered ports through the plates in communication with the reduced pressure source is adjusted. In this manner, the magnitude of the reduced pressure force applied to the web to maintain the web in contact with the conveying surface can be increased or decreased as desired.

The discharging end portion of the vacuum conveyor is spaced a preselected distance from the vacuum roll and the window patch severing apparatus associated with the vacuum roll. Thus between the conveyor discharging end portion and the point at which the web is engaged on the periphery of the vacuum roll, the web is pushed forwardly by the conveying action generated by the vacuum conveyor. Preferably the web of patch material is conveyed a preselected distance from the point of adhesive application to the point where the web is severed to assure a desired presetting of the adhesive on the surface of the web while maintaining a preselected feed rate of the web.

Still further in accordance with the present invention there is provided apparatus for severing window patches from a web of patch material where the web of patch material has a first surface and a second surface. Adhesive applying means is included for applying adhesive to selected portions of the first surface of the web of patch material. Feeding means is employed for feeding the web to the adhesive applying means. A vacuum roll has a peripherial surface for engaging the second surface of successive window patches with the adhesive on the first surface thereof. There is severing means positioned upstream of the vacuum roll for severing successive window patches of a preselected length from a leading end of the web while a portion of the leading end of the web is engaged with the surface of the vacuum roll. The severing means is positioned in a linear feed path between the adhesive applying means and the vacuum roll. There is included web positioning means for positioning the web of patch material within the severing means to prevent contact between the severing means and the adhesive on selected portions of the first surface of the web of patch material.

Accordingly, the principal object of the present invention is to provide apparatus for severing window patches from a web of patch material where adhesive is applied to selected portions of the web and the web fed a preselected distance at a preselected feed rate to permit presetting of the adhesive before the severed window patches are applied to the envelope blanks.

The further object of the present invention is to provide a high-speed envelope machine web patching apparatus that includes a vacuum conveyor for conveying the web patch material with adhesive on one surface thereof a preselected distance between the point of adhesive application and the point of severing window patches from the web.

Another object of the present invention is to provide web patch conveying apparatus for continuously conveying at a preselected rate along a linear path of a preselected length a web of patch material with adhesive on one surface thereof between the point of application of the adhesive and the point of severing window patches from the web to permit desired presetting of the adhesive to obtain complete bonding of the severed window patches to envelope blanks.

Still another object of the present invention includes providing a web patch conveying apparatus of the type described which includes a means for preventing any of the adhesive on the one surface of the web from being brought into contact with the apparatus for severing the window patches from the web.

These and other objects of the present invention will be more completely disclosed and described in the following specification, the accompanying drawings, and the appended claims.

DESCRIPTION OF THE PREFERRED EMBODIMENT

Figure 1:
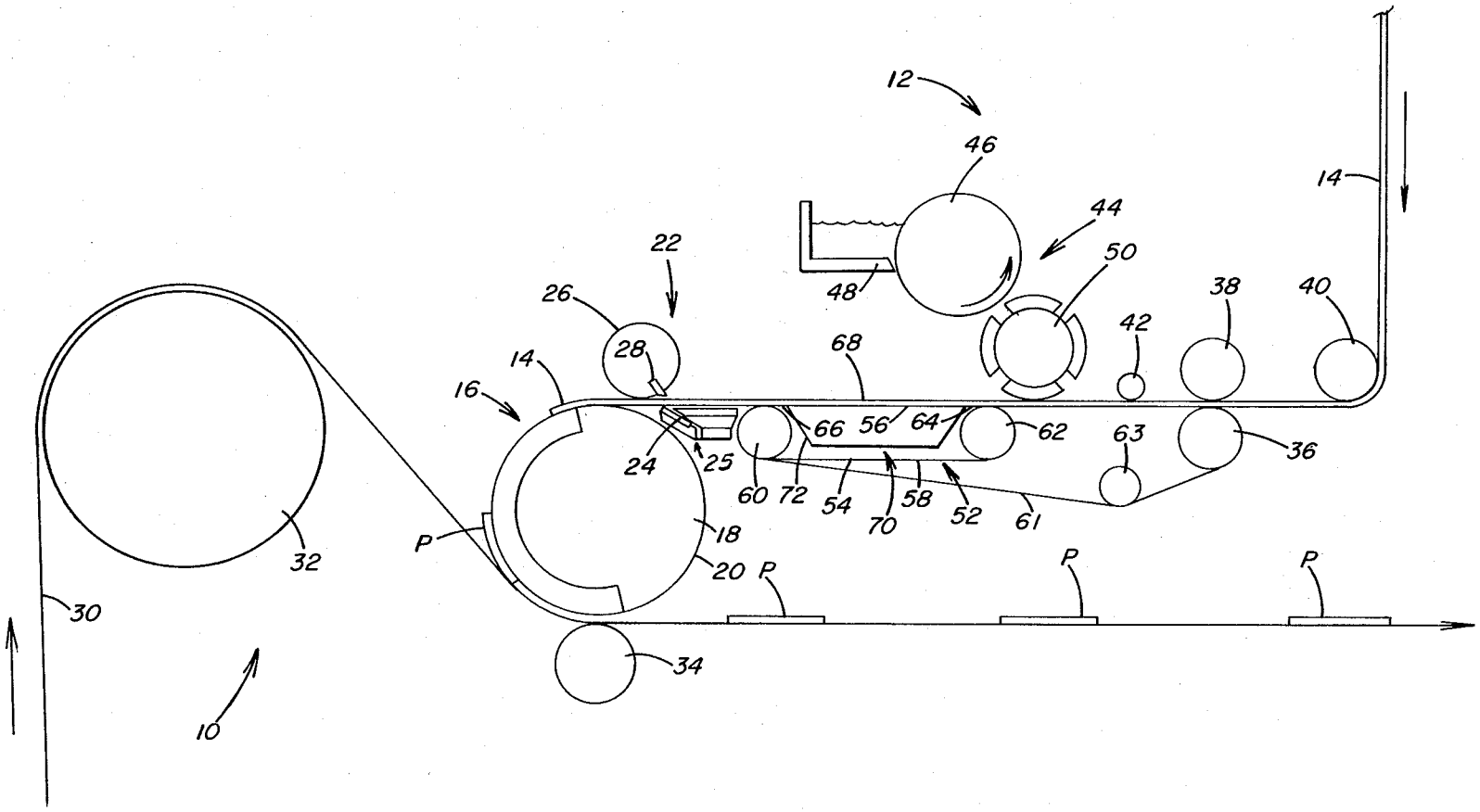
FIG. 1 is a schematic view of a portion of an envelope making machine, illustrating the apparatus for forming window patches that are adhesively applied to envelope blanks or a web of envelope material from which blanks are cut.

Referring to the drawings and particularly to FIG. 1, there is schematically illustrated a portion of an envelope making machine generally designated by the numeral 10 that includes a window patch supplying apparatus generally designated by the numeral 12. The window patch supplying apparatus 12 includes a reel (not shown) for a web 14 of window patch material. Patch transfer apparatus generally designated by the numeral 16 includes a vacuum roll 18 mounted on a shaft (not shown) conventionally supported in an envelope machine frame. The vacuum roll 18 is conventional in design and includes a series of rows of suction or vacuum ports that open onto a roll periphery 20. As well known in the art, the rows of vacuum ports are connected to longitudinally extending passageways which are connected through suitable valve means to a vacuum pump or similar device to provide a partial vacuum or a reduced pressure at the suction ports when the suction ports are in preselected angular positions relative to the other components of the envelope machine.

Window patch severing apparatus generally designated by the numeral 22 is associated with the vacuum roll 18 and includes a fixed knife blade 24 suitably mounted beneath the web 14 near the periphery 20 of the vacuum roll 18. A roll 26 with a backing knife blade 28 mounted thereon is mounted above the web 14 in alignment with the fixed blade 24. The roll 26 is arranged to rotate at a preselected ratio with the vacuum roll 18 to sever successive selected lengths of window patch material from the web 14. Preferably the roll 26 rotates at the speed of the envelope machine drive shaft. With this arrangement the knife blades 24 and 28 are arranged to sever a window patch of a preselected length from a leading end of the web 14 of patch material. The patch severing apparatus 22 is arranged to sever window patches of variable length while the envelope machine is running. It will be noted that the fixed blade 24 is preferably mounted relative to a web positioning device 25, the purpose and function of which will be discussed in detail hereinbelow.

At least a portion of the leading end of the web 14 of patch material is engaged on the surface of the vacuum roll 18, and a window patch P is severed therefrom. The free window patch P with adhesive secured to the outer surface, in a manner to be explained later in greater detail, remains engaged on the roll periphery 20. A web 30 of envelope blank material having windows cut out from the web 30 at spaced intervals along the length thereof is fed at a preselected rate around an idler roll 32 between the vacuum roll 18 and a back-up roll 34. With the window patch engaged to the vacuum roll 18, rotation of the vacuum roll transfers the patch P into overlying relation with the respective cut out window in the web 30 of envelope blank material.

As the envelope web 30 moves between the vacuum roll 18 and the back-up roll 34, window patch P adhesively engages the web 30 and is compressed by the rolls 18 and 34 onto one surface of the web 30. The rolls 18 and 34 are in abutting relation with each other so as to adhesively secure the patch to the web 30 surrounding the periphery of a cut out window in the web 30. It should also be understood that the patch P can be applied to an envelope blank severed from the web 30 where the blank is conveyed between the vacuum roll 18 and the back-up roll 34.

The web 14 of window patch material is engaged by a pull roll 36 and an idler roll 38 and is fed by the rolls 36 and 38 around an idler roll 40. The web 14 is threaded around the periphery of the idler roll 40 and between the rolls 36 and 38. Preferably, the pull roll 36 has a sprocket (not shown) secured thereto for rotation with an output shaft of a variable speed drive, such as a P.I.V. gear type variable speed drive well known in the art. The output shaft of the web pull roll 36 is drivingly connected to the envelope machine drive shaft and is driven at a fixed ratio to the speed of the envelope machine drive shaft. The speed of the pull roll 36 can be increased or decreased as desired to feed the web 14 at a preselected patch web speed.

The rolls 36 and 38 unwind the web 14 of window patch material from a roll and feed the web 14 beneath a deflector roll 42 to an adhesive applicator generally designated by the numeral 44. The adhesive applicator 44 includes a roll 46 positioned adjacent to a reservoir of adhesive material or gum box 48. The adhesive material is transferred from the reservoir 48 by roll 46 to an applicator roll 50 that applies the adhesive material to selected portions of the web 14 of window patch material in a well known manner. Preferably, the roll 46 is also driven by the P.I.V. variable speed gear drive at the patch web speed. The applicator roll 50 is driven at the speed of the envelope machine drive shaft.

The web 14 of window patch material with adhesive applied to selected portions on one surface of the web is conveyed in accordance with the present invention by a vacuum conveyor generally designated by the numeral 52 from the adhesive applicator 44 to the vacuum roll 18 and the window patch severing apparatus 22. The vacuum conveyor 52 is operable to advance the web 14 with adhesive applied thereto along a linear path, for example, a horizontal linear path as illustrated in FIG. 1, for a preselected distance from the adhesive applicator 44 to the severing apparatus 22. This arrangement permits the desired degree of presetting of the adhesive applied to the web 14 before the window patches are severed. This is particularly adaptable in high speed patch making operations and eliminates the problems normally encountered with vacuum roll transfer of the gummed web to the patch severing apparatus. With vacuum roll transfer, the web is fed along an arcuate path and does not follow a linear path. Thus, for example, the distance between the applicator roll and the severing apparatus is insufficient to obtain the desired degree of presetting of the adhesive on the web 14 for high speed window patch making operations.

Figure 2:
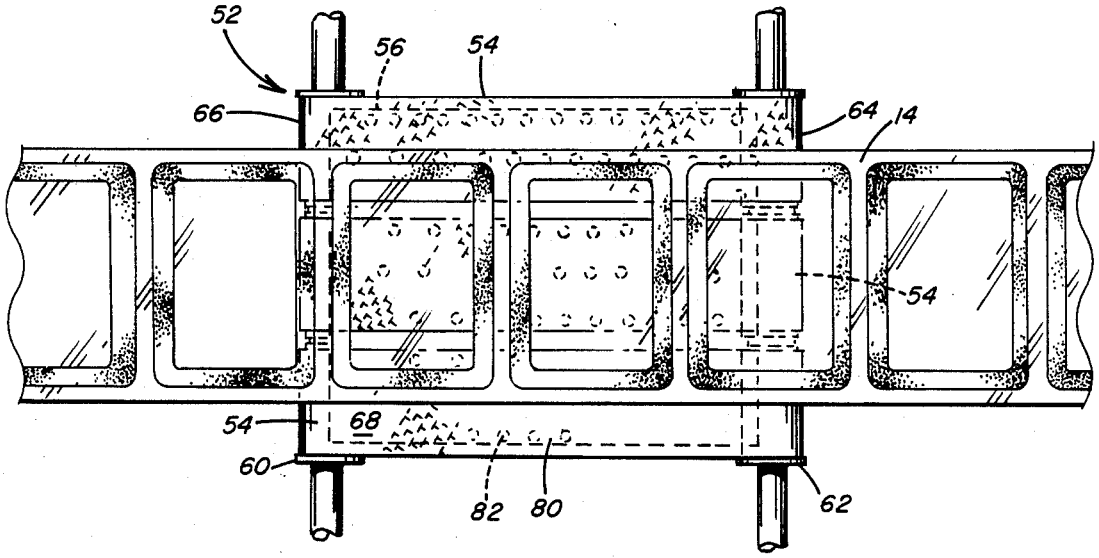
FIG. 2 is a schematic top plan view of the web conveying apparatus for conveying the web of patch material from an adhesive applicator to patch severing apparatus, illustrating a pair of ported plates positioned between the upper surface of a porous conveyor and a source of reduced pressure.

As illustrated in greater detail in FIG. 2, the vacuum conveyor 52 includes a continuous belt-type conveyor 54 having an upper run 56 and a lower run 58. The upper and lower runs 56 and 58 are reeved at opposite ends around a driven roll 60 and an idler roll 62. The driven roll 60 is preferably driven at the speed of the pull roll 36 and the adhesive transfer roll 46 by the P.I.V. variable speed drive. The conveyor 54 may include, in one embodiment, a single porous conveyor belt or, as illustrated in FIG. 2, a plurality of individual porous conveyor belts 54 reeved about the rolls 60 and 62 and positioned in spaced parallel relation below the web 14. Preferably, each conveyor 54 is fabricated of a suitable porous material having passages or aperatures through which air is drawn downwardly through the upper conveyor run 56 immediately below the web 14. A timing belt 61 extends around rolls 36 and 60 and idler roll 63.

As further illustrated in FIG. 1, the conveyor 54 has a web receiving end portion 64 and a web discharging end portion 66. The web receiving end portion 64 is supported by the idler roll 62 closely adjacent to the adhesive applicator roll 50 so that the web 14, after being applied with adhesive material, is immediately transferred to the receiving end portion 64. The web discharging end portion 66, however, is spaced a substantial distance from the vacuum roll 18 and is not positioned closely adjacent thereto. By substantially spacing the web discharging end portion 66 from the vacuum roll 18 and the severing apparatus 22, the web 14 is pushed by the conveying action of the vacuum conveyor 54 from the discharging end portion 66 to the severing apparatus 22. This provides an increase in the web patch conveying distance from the point of applying adhesive on the web 14 to the point of severing window patches from the web 14.

Figure 3:
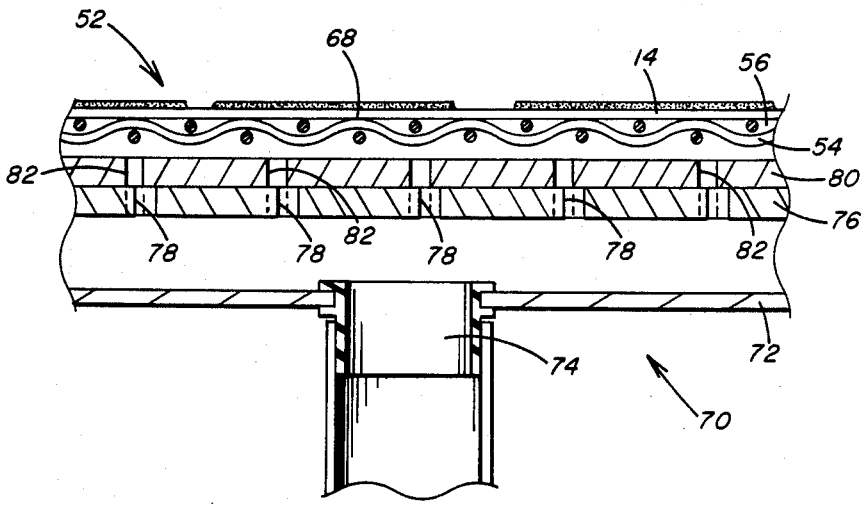
FIG. 3 is a fragmentary schematic sectional view of the ported plates and the porous conveying surface, illustrating the alignment of the ports in the plates to control the magnitude of the reduced pressure force applied to the porous conveying surface on which the web material is conveyed.

The web 14 of window patch material is maintained in contact with a porous conveying surface 68 on the upper conveyor run 56 by the application of a reduced pressure force on the conveying surface 68. The source of the reduced pressure force is a vacuum box generally designated by the numeral 70. The vacuum box 70 includes a housing 72 having a preselected length whereby the driven roll 60 and the idler roll 62 are positioned adjacent the opposite ends of the housing 72. With this arrangement, the housing 72 is positioned between the conveyor upper and lower runs 56 and 58. The housing 72 has a vacuum passageway 74 FIG. 3 which is connected through suitable valve means (not shown) to a vacuum pump or similar device as utilized with the vacuum roll 18, to provide a partial vacuum at the upper conveying surface 68.

A stationary plate 76 is positioned at the top of the housing 72 above the vacuum passageway 74 and below the conveyor upper run 56. The stationary plate 76 has a plurality of suction ports 78 therethrough. The suction ports 18 are open to the vacuum passageway 74 of the vacuum box 70. A movable plate 80 is positioned in overlying relation with the stationary plate 76. The movable plate 80 is suitably supported for movement relative to the stationary plate 76. The movable plate 80 also includes a plurality of suction ports 82. The movable plate 80 is maneuvered in a horizontal plane to a position relative to the stationary plate 76 where the suction ports 78 and 82 are arranged in preselected registry to provide a plurality of continuous passageways extending from the vacuum passageway 74 through the plates 76 and 80 to the porous conveying surface 68.

Further in accordance with the present invention, by placing the ports 78 and 82 in selected registry, the dimension of the passageways through the plates 76 and 80 for the application of reduced pressure on the conveying surface 68 is controlled. This, in turn, controls the magnitude of the reduced pressure force on conveyor surface 68. The movable plate 80 is advanced to a preselected position where, for example, the ports 82 of the movable plate 80 are in complete alignment with the ports 78 of the stationary plate 76. This provides the maximum openings through the passageways of the overlying plates 76 and 80 and the maximum degree of reduced pressure applied to the conveying surface 68. Accordingly, by moving the plate 80 relative to the plate 76 to a position where a portion of the ports 78 are partially obstructed or blocked by the movable plate 80, passageways of reduced dimension are provided through the plates 76 and 80. In this manner, the magnitude of the reduced pressure force applied to the conveying surface 68 is reduced. Accordingly, the ports 78 in plate 76 can be completely blocked by the movable plate 80, and the reduced pressure force is completely removed from the conveying surface 68. Consequently by selectively moving the plate 80 relative to the plate 76, the magnitude of the reduced pressure force applied to the conveying surface 68 is controlled.

Adjusting the partial vacuum applied to the conveying surface 68 is selected as determined by the operating conditions of the envelope machine, for example, the envelope machine speed and the patch web speed. This permits lower vacuum pressures to be applied to the conveying surface 68 to maintain the web 14 in positive contact with the conveyor upper run 56 for all patch web speeds utilized.

After the web 14 passes beneath the adhesive applicator roll 50, the vacuum conveyor 54 pulls the web 14 from beneath the roll 50 onto the web receiving end portion 64 and over the surface 68 to the web discharging end portion 66. From the web discharging end portion 66, the web 14 is pushed by the conveying action generated by the conveyor 54 to the vacuum roll 18 and the severing apparatus 22. Thus, by utilizing the vacuum conveyor 52 to push the web 14 to the severing apparatus 22, an increase in the conveying distance from the point of adhesive application on the web 14 to the point of severing the web 14 is obtained. This permits the adhesive applied to the web 14 to preset before the web 14 is severed and the window patches P are applied to the envelope blank between the vacuum roll 18 and the back-up roll 34.

It should be noted that the preferred envelope making machine 10 primarily utilizes the conveying action of the conveyor 54 to advance the web to the vacuum roll 18. As mentioned hereinabove, the surface of the vacuum roll 18 only initially engages at least a portion of a leading end of the web 14 of patch material prior to the window patch P being severed by the severing apparatus 22. As can be seen in FIG. 1, this minimum engagement of the leading end of the web 14 is sufficient for insuring that the severed window patch P will eventually be brought into full contact with the surface of the roll 18 after it has been severed. However, the initial contact with only a portion of a leading end of the web 14 may be insufficient to actually pull the web 14 through the severing apparatus 22 which, as mentioned before, is primarily being fed the web 14 by the conveyor 54.

Figure 4:
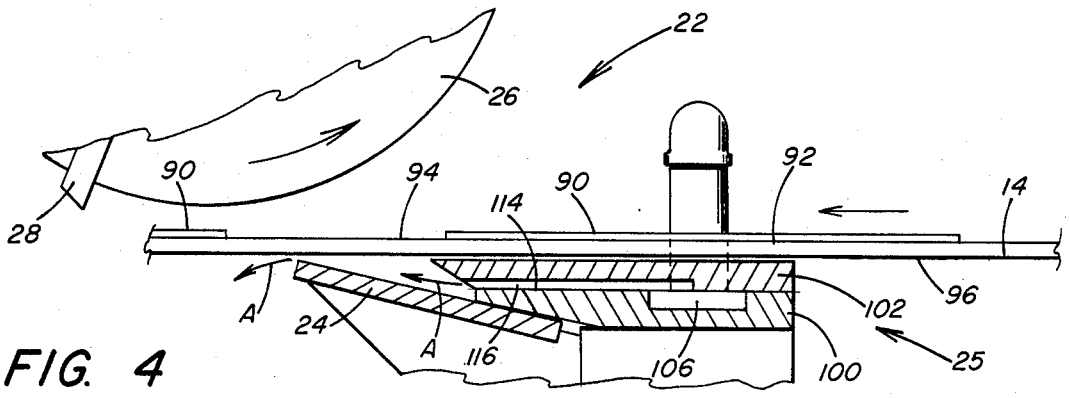
FIG. 4 is a sectional side view of the preferred web positioning device associated with the patch severing apparatus for preventing contact between the patch severing apparatus and adhesive on the web.
Figure 5:
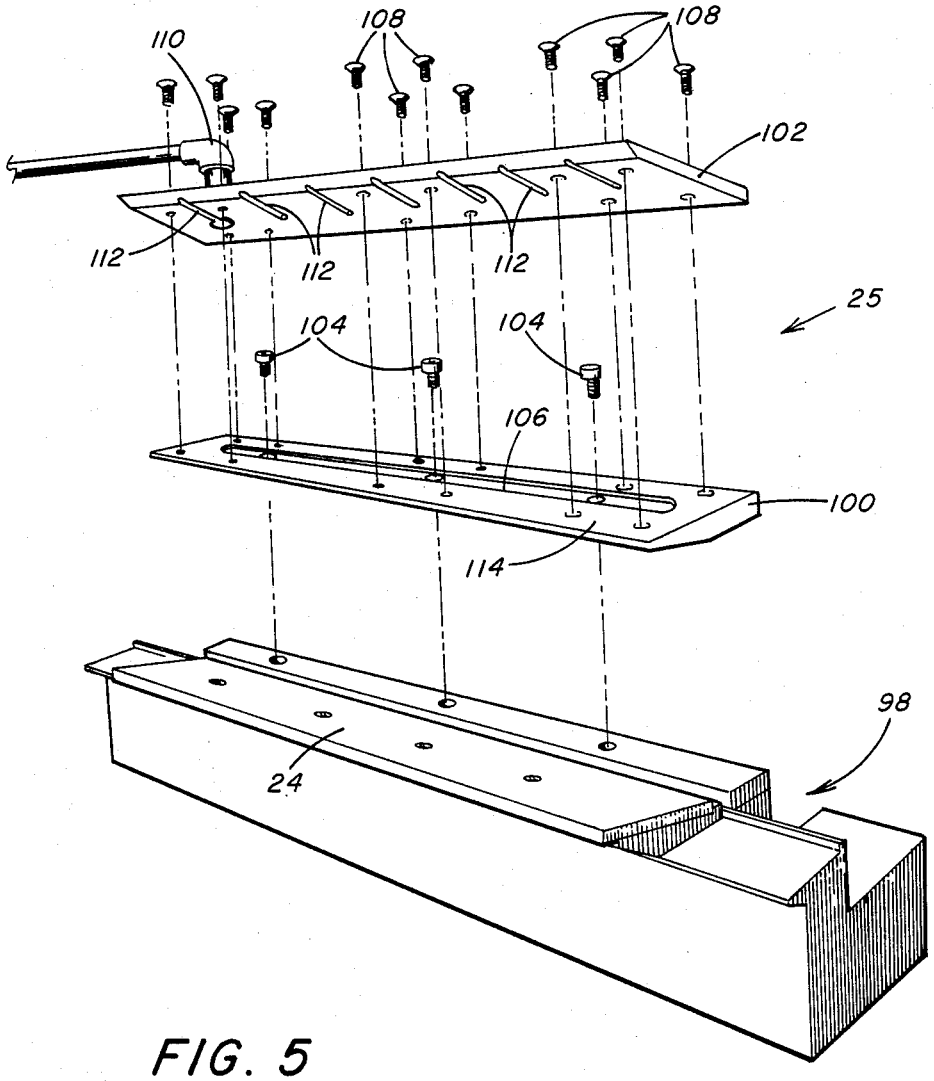
FIG. 5 is an exploded perspective view of the web positioning device shown in FIG. 4 including various features of the invention.

As seen in FIGS. 4 and 5, the web positioning device 25 is intended to position the web 14 within the severing apparatus 22 to prevent contact between the severing apparatus 22 and the adhesive 90 on selected portions of the first surface 92 of the web 14 of patch material. Specifically, since the severing apparatus 22 includes the fixed blade 24 and the movable blade 28 on roll 26, it is desirable for the web 14 to pass therebetween in a manner which will prevent the adhesive 90 from being brought into contact with the movable blade 28. Accordingly, the web positioning device 25 is intended to position the web relatively toward the fixed blade 24 so that the movable blade 28 will only be brought into contact with the first surface 92 at an area 94 thereof between the selected portions of the first surface 92 of the web 14 where adhesive 90 has been applied.

Without the web positioning device 25, it would be possible for the engagement between the portion of the leading end of the web 14 and the vacuum roll 18 to be insufficient to insure that the web 14 will keep moving until it reaches the fixed blade 24. In other words, since the conveying action of the web 14 is primarily generated by the conveyor 54, the first surface 92 of the web 14 can be relatively positioned toward the roll 26 to allow the movable blade 28 thereon to make contact with the trailing edge of the adhesive 90 on the patch P which is about to be severed thereby.

Basically, the preferred web positioning device 25 produces a pressure differential across the web 14 in the area of the blades 24, 28 by producing a first pressure on the first surface 92 thereof and a second pressure on a second surface 96 of the web 14 wherein the first pressure is higher than the second pressure. Specifically, the preferred pressure differential is created by directing rapidly flowing air, as indicated by the arrow A, between the second surface 96 of the web 14 and the fixed blade 24. The rapidly flowing air A causes the second pressure on the second surface 96 to be below atmospheric pressure as the first pressure above the first surface 92 of the web 14 remains at about atmospheric pressure. The air flow A is generally parallel with and in the same direction as the linear feed path of the web 14 and has a greater velocity than the web 14 passing between the fixed blade 24 and the movable blade 28. Accordingly, the preferred web positioning device 25 is along the linear feed path between the vacuum conveyor 52 and the severing apparatus 22.

As seen in FIG. 5, the preferred web positioning device 25 includes a base 98 which also serves as the primary support for the fixed blade 24. It should be understood that the fixed blade 24 can nevertheless be adjusted in its mounting on the base 98 to insure proper alignment with the movable blade 28 for proper severing of the web 14 therebetween. More significantly, the web positioning device 25 includes a lower portion 100 and an upper portion 102. The lower portion 100 is mounted by screws 104 to the base 98 and includes an internal channel 106 which is intended to serve as a supply chamber for the rapidly flowing air A of the web positioning device 25. The upper portion 102 overlies the lower portion 100 and is secured thereto by a plurality of screws 108. Additionally, the upper portion 102 includes a pipe fitting 110 which is aligned with the internal channel 106 of the lower plate 100 and, when coupled to an external source of pressurized air, provides a continuing supply of presurized air thereto. Further, the upper plate 102 includes a plurality of grooves 112 in a lower surface thereof. The grooves 112 include rearward ends which overlies the channel 106 and, when bound by an upper surface 114 of the lower portion 100, form a plurality of discharge jets 116 (FIG. 4) for the pressurized air within the channel 106. Specifically, the plurality of discharge jets 116 are in a spaced array extending transversely of the web 14 with each of the discharge jets 116 being generally parallel with the linear feed path in order to provide the desired rapidly flowing air A. Consequently, the introduction of pressurized air to the fitting 110 will cause the rapidly flowing air A to lower the pressure on the second surface 96 of the web 14 to prevent the first surface 92 of the web 14 from being displaced from the fixed blade 24 toward the movable blade 28. Preventing the displacement of the web 14 toward the movable blade 28 allows the blade 28 to only make contact with the area 94 between the adhesive 90 on the first surface 92 of the web 14 and prevents any adhesive from eventually being contacted by and collected on the movable blade 28.

According to the provisions of the patent statutes, I have explained the principle, preferred construction, and mode of operation of my invention, and have illustrated and described what I now consider to represent its best embodiment. However, it should be understood that, within the scope of the appended claims, the invention may be practiced otherwise than as specifically illustrated and described.

For example, although the preferred envelope making machine 10 employs the vacuum conveyor 52 because of the desire to insure sufficient time for the adhesive to preset, if this were not a desired objective, the preferred web positioning device 25 could be independently employed to insure proper severing by a separate severing apparatus 22. If time for presetting is considered unnecessary for some types of machines or some types of adhesives, the feed rolls 36, 38 and/or the adhesive applicator 44 could be relocated physically on the linear feed path toward the severing apparatus 22. It is possible that either or both of these elements could be configured to "push" the web with adhesive thereon to the severing apparatus 22 where the preferred web positioning device 25 could be employed to prevent the adhesive from being brought into contact with the movable blade 28 in the same manner as described hereinabove.

I claim:

1. Apparatus for severing window patches from a web of patch material:

having a first surface and a second surface;

said apparatus defining a linear feed path having an upstream end and a downstream end;

web feeding means at said upstream end of said linear feed path;

adhesive applying means located along said linear feed path beyond said web feeding means for applying adhesive to selected portions of said first surface of said web of patch material;

a vacuum roll located along said linear feed path beyond said adhesive applying means and having a peripheral surface for engaging said second surface of successive window patches with said adhesive on said first surface thereof;

severing means positioned along said linear feed path between said adhesive applying means and said vacuum roll for severing said successive window patches of a pre-selected length from a leading end of said web while a portion of said leading end of said web is engaged with said surface of said vacuum roll;

a vacuum conveyor positioned along said linear feed path between said adhesive applying means and said severing means, said vacuum conveyor being operable to advance said web with said adhesive on said first surface of said web along said linear feed path from said adhesive applying means toward said severing means; said vacuum conveyor having a receiving end positioned adjacent said adhesive applying means for receiving said web after said adhesive is applied to said first surface thereof, said vacuum conveyor having a discharging end spaced upstream from said severing means in said linear feed path;

said severing means being positioned in said linear feed path between said discharging end of said vacuum conveyor and said vacuum roll;

said severing means being spaced from said discharging end of said vacuum conveyor with said vacuum roll being spaced from said severing means to provide an extended linear distance between said discharging end and said vacuum roll for pushing said web by a conveying action of said vacuum conveyor from said discharging end to said severing means, and said vacuum conveyor being constructed and arranged for pushing said web along said linear feed path from said discharging end a preselected distance through said severing means and therefrom to the point where said portion of said leading end of said web is engaged with said peripheral surface of said vacuum roll prior to said severing means severing each window patch from said leading end of said web.

2. Apparatus as set forth in claim 1, wherein said vacuum conveyor includes a porous conveying surface facing said linear movement path for receiving said web of patch material thereon, a source of reduced pressure operatively coupled to said porous conveying surface for applying a reduced pressure force to said porous conveying surface to maintain said web of patch material to contact with said conveying surface and advance said web from said receiving end to said discharging end, and means interposed between said source of reduced pressure and said porous conveying surface for controlling a magnitude of said reduced pressure force applied to said porous conveying surface.

3. Apparatus as set forth in claim 2, wherein said means for controlling said magnitude of said reduced pressure force includes a stationary plate positioned below said porous conveying surface and above said source of reduced pressure, said stationary plate having a plurality of first suction ports therethrough, a movable plate positioned in overlying relation with said stationary plate and below said porous conveying surface, said movable plate having a plurality of second suction ports therethrough, and said movable plate being positioned for movement relative to said stationary plate to place said second suction ports in selected registry with said first suction ports to control said magnitude of said reduced pressure force applied to said porous conveying surface.

4. Apparatus as set forth in claim 1, wherein said vacuum conveyor includes a porous conveyor belt having an upper run and a lower run, said upper run being supported adjacent said linear movement path to form a conveying surface for receiving said web of patch material thereto, driving means engaging said porous conveyor belt for driving said conveyor belt to advance said web of patch material at a preselected feed rate on said conveying surface from said receiving end to said discharging end, and a source of a reduced pressure force applied to said conveying surface and having means for controlling a magnitude of said reduced pressure force applied to said conveying surface to maintain said web of patch material thereon.

5. Apparatus as set forth in claim 1, further including means for applying a reduced pressure force of a preselected magnitude to a conveying surface of said vacuum conveyor to maintain said web of patch material in contact with said conveying surface for advancing said web of patch material from said adhesive applying means to said severing means at a preselected feed rate.

6. Apparatus as set forth in claim 1, further including web positioning means located adjacent said linear movement path for positioning said web of patch material within said severing means to prevent contact between said severing means and said adhesive on said selected portions of said first surface of said web of patch material.

7. Apparatus as set forth in claim 1, wherein said severing means includes a fixed blade and a movable blade, said blades being positioned on opposite sides adjacent said linear movement path for severing said successive window patches as said web of patch material passes therebetween, said fixed blade being adjacent the path taken by said second surface of said web, said movable blade being adjacent the path taken by said first surface of said web, and further including a web positioning means for positioning said web within said severing means relatively toward said fixed blade.

8. Apparatus as set forth in claim 7, wherein said web positioning means is constructed and arranged to maintain said web toward said fixed blade to prevent contact between said movable blade and said adhesive on said selected portions of said first surface of said web of patch material.

9. Apparatus as set forth in claim 7, wherein said web positioning means includes pressure differential means operatively associated with said linear movement path for producing a first pressure on said first surface of said web and a second pressure on said second surface of said web which said first pressure is higher than said second pressure.

10. Apparatus as set forth in claim 9, wherein said pressure differential means includes air flow directing means adjacent the side of said linear path taken by said second surface of said web for directing rapidly flowing air between said second surface and said fixed blade to cause said second pressure to be below atmospheric pressure as said first pressure is at said atmospheric pressure.

11. Apparatus as set forth in claim 10, wherein said air flow directing means as constructed and arranged to direct said rapidly flowing air generally parallel with and in a same direction as said linear feed path and has a greater velocity than said web passing between said fixed blade and said movable blade and said air flow directing means is located along said linear feed path between said vacuum conveyor and said severing means.

12. Apparatus as set forth in claim 11, wherein said air flow directing means includes a source of pressurized air and a plurality of discharged jets from said source of pressurized air, said plurality of discharged jets are in a spaced array extending transversely of said web, and each of said discharged jets is generally parallel with said linear feed path.

13. Apparatus for severing window patches from a web of patch material having a first surface and a second surface;

said apparatus defining a linear feed path having an upstream end and a downstream end;

web feeding means at said upstream end of said linear feed path;

adhesive applying means located along said linear feed path beyond said web feeding means for applying adhesive to selected portions of said first surface of said web of patch material;

a vacuum roll located along said linear feed path beyond said adhesive applying means and having a peripheral surface for engaging said second surface of successive said window patches with said adhesive on said first surface thereof;

severing means positioned along said linear feed path between said adhesive applying means and said vacuum roll for severing said successive window patches of a preselected length from a leading end of said web while a portion of said leading end of said web is engaged with said surface of said vacuum roll;

said severing means being positioned in a linear feed path between said adhesive applying means and said vacuum roll; and web positioning means located adjacent said linear movement path for positioning said web of patch material within said severing means to prevent contact between said severing means and said adhesive on said selected portions of said first surface of said web of patch material; and a vacuum conveyor positioned between said adhesive applying means and said severing means, said vacuum conveyor being operable to advance said web with said adhesive on said first surface of said web along said linear feed path from said adhesive applying means toward said severing means.

14. Apparatus for severing window patches from a web of patch material having a first surface and a second surface;

said apparatus defining a linear feed path having an upstream end and a downstream end;

web feeding means at said upstream end of said linear feed path;

adhesive applying means located along said linear feed path beyond said web feeding means for applying adhesive to selected portions of said first surface of said web of patch material;

a vacuum roll located along said linear feed path beyond said adhesive applying means and having a peripheral surface for engaging said second surface of successive said window patches with said adhesive on said first surface thereof;

severing means positioned along said linear feed path between said adhesive applying means and said vacuum roll for severing said successive window patches of a preselected length from a leading end of said web while a portion of said leading end of said web is engaged with said surface of said vacuum roll;

said severing means being positioned along said linear feed path between said adhsive applying means and said vacuum roll;

said severing means including a fixed blade and a moveable blade for severing said successive window patches as said web of patch material passes therebetween;

said fixed blade being adjacent a side of said linear feed path taken by said second surface of said web;

said moveable blade being adjacent the side of said linear feed path taken by said first surface of said web;

web positioning means along said linear feed path for positioning said web within said severing means relatively toward said fixed blade; and a vacuum conveyor positioned adjacent said linear feed path between said adhesive applying means and said severing means, said vacuum conveyor being operable to advance said web with said adhesive on said first surface of said web along said linear feed path from said adhesive applying means toward said severing means.

15. Apparatus as set forth in claim 14, wherein said web positioning means includes pressure differential means constructed and arranged for producing a first pressure on said first surface of said web and a second pressure on said second surface of said web which said first pressure is higher than said second pressure.

16. Apparatus as set forth in claim 15, wherein said pressure differential means includes air flow directing means adjacent the side of said linear feed path taken by said second surface of said web directing rapidly flowing air between said second surface and said fixed blade to cause said second pressure to be below atmospheric pressure as said first pressure is at said atmospheric pressure.

17. Apparatus as set forth in claim 16, wherein said rapidly flowing air is generally parallel with and in a same direction as said linear feed path and has a greater velocity than said web passing between said fixed blade and said moveable blade and said air flow directing means is located along said linear feed path between said adhesive applying means and said severing means.

18. Apparatus as set forth in claim 17, wherein said air flow directing means includes a source of pressurized air and a plurality of discharged jets from said source of pressurized air, said plurality of discharged jets are in a spaced array extending transversely of said web, and each of said discharged jets is generally parallel with said linear feed path.

* * * * *